US007481226B2

(12) United States Patent
Cholet

(10) Patent No.: US 7,481,226 B2
(45) Date of Patent: Jan. 27, 2009

(54) METHOD AND DEVICE FOR ANALYZING CIGARETTE SMOKING

(75) Inventor: Georges Cholet, Ormes (FR)

(73) Assignee: Societe Nationale d'Exploitation Industrielle des, Tabecs et Allumettes, Paris (FR)

( * ) Notice: Subject to any disclaimer, the term of this patent is extended or adjusted under 35 U.S.C. 154(b) by 357 days.

(21) Appl. No.: 11/036,218

(22) Filed: Jan. 18, 2005

(65) Prior Publication Data

US 2006/0130860 A1 Jun. 22, 2006

(30) Foreign Application Priority Data

Dec. 22, 2004 (FR) ..... 04 13764

(51) Int. Cl.
*A24F 47/00* (2006.01)

(52) U.S. Cl. ..... 131/330; 131/187; 131/273; 131/904; 73/865.4

(58) Field of Classification Search ..... 131/273, 131/330, 187, 328, 329, 904, 906, 908; 73/865.4, 73/865.6, 865.9
See application file for complete search history.

(56) References Cited

U.S. PATENT DOCUMENTS 3,732,874 A * 5/1973 Wagner et al. ..... 131/330
3,994,307 A * 11/1976 Loeffler ..... 131/330
4,365,640 A * 12/1982 Lorenz et al. ..... 131/330
4,858,628 A * 8/1989 Norman et al. ..... 131/329
2003/0145868 A1* 8/2003 Halder ..... 131/329
2006/0130860 A1* 6/2006 Cholet ..... 131/330

* cited by examiner

*Primary Examiner*—Eric Hug
(74) *Attorney, Agent, or Firm*—Browdy and Neimark, P.L.L.C.

(57) ABSTRACT

A method for analysing cigarette smoking, which includes equipping a smoker with a portable assembly including a cigarette holder equipped with a detector to detect smoking-related parameters and a processor connected to the detectors. The processing module includes memory with date/time recording of the detected parameters and transfer devices for transferring data related to these parameters. A smoking test is performed during which the smoker equipped with the assembly smokes cigarettes with the cigarette holder over a period of time. Real-time detection is performed by the detectors and the results are stored so as to obtain a smoking profile specific to the smoker over the time period. The above data is then transferred to a processing center including a smoking machine, and the smoking machine is controlled using the transferred data so as to obtain the mechanical reproduction (duplication) of smoking in accordance with the smoking profile.

10 Claims, 2 Drawing Sheets

METHOD AND DEVICE FOR ANALYZING CIGARETTE SMOKING

BACKGROUND OF THE INVENTION

1. Field of the invention

The present invention concerns a method and device for analysing cigarette smoking.

2. Description of the prior art

As a general rule, it is known that, for cigarette comparison, smoking machines have been developed which operate under standardized smoking conditions (puffs of bell-shaped profile having a volume of 35 ml and lasting 2 seconds with a pause of 60 seconds between each puff).

With the advent of low-tar and low-nicotine cigarettes, cigarette manufacturers have sought to investigate the behaviour of smokers in relation to the product they smoke.

Apparatus has therefore been produced with which it is possible to store in memory the manner in which smoker smoke their cigarettes. Cigarette holders have consequently been developed equipped with means for measuring puff rate and draw and with sensors detecting the contact of the cigarette holder with the smoker's lips.

Up until now, cigarettes holders were permanently connected to an electronic processing module of a fixed laboratory installation designed to determine and process a certain number of parameters, such as:

puff volume,
puff duration,
inter-puff interval,
average puff rate,
number of puffs/cigarette,
total exhaled volume,
average volume/puff,
total puff duration,
mean duration/puff,
total inter-puff interval,
mean inter-puff interval.

The disadvantage of solutions of this type is that smokers who take part in tests using this kind of installation are not in their usual environment, and are not able to go about their usual occupations. Therefore, at the time of these tests, their behaviour is different from their usual behaviour.

This disadvantage is reproduced when the parameters determined by the processing module are used to establish a smoking profile using instantaneous puff rate and draw values for example, with a view to reproducing this smoking on a smoking machine piloted by the electronic module (for example a single port smoking machine piloted by a stepping motor). This machine then substitutes for the smoker to reproduce mechanically the smoking of one or more cigarettes in accordance with the previously recorded smoking profile, to analyse yields under such conditions.

In addition, in either case this solution has the disadvantage of compelling the smokers to travel in order to come and smoke in a laboratory. Also, on account of the relatively high cost of this equipment, laboratories generally only have one such item of equipment.

OBJECT OF THE INVENTION

The particular objective of the invention is to overcome these disadvantages.

SUMMARY OF THE INVENTION

For this purpose, it proposes a method comprising the following steps:

equipping a smoker with a portable assembly comprising a cigarette holder fitted with means for detecting smoking-related parameters and a processing module connected to said detection means, this processing module comprising memorization means with date and time recording of the detected parameters and means for transferring the data on these parameters, a smoking test during which the smoker equipped with said assembly smokes one or more cigarettes using the cigarette holder over a normal period of activity and according to usual habit, real-time detection by said detection means and memorisation by said memorisation means, during said period, of data on said date/time parameters so as to obtain a specific smoking profile of the smoker throughout said time period, once the above test has been conducted, transferring said data to a processing centre equipped with a smoking machine, piloting the smoking machine using the data transferred to said centre in order to obtain mechanical reproduction (duplication) of smoking as per said smoking profile.

Evidently, the invention also concerns the device enabling implementation of the method just described, this device comprising:

firstly, a cigarette holder equipped with detection means and a processing module connected thereto, this unit comprising means for memorising and transferring data on parameters detected by the detection means, and secondly, a processing centre able to receive the data sent by said memorisation and transfer means comprising a smoking machine controlled by an electronic piloting module in relation to said data.

BRIEF DESCRIPTION OF THE DRAWINGS

An embodiment of the invention is described below as a non-restrictive example with reference to the appended drawings, in which.

DESCRIPTION OF THE PREFERRED EMBODIMENTS

In these examples, the purpose of the invention is more particularly to take advantage of current technology to reduce the cost of the device assembly whilst improving its performance, so that it is possible to provide each smoking test participant with a mobile assembly 1 that is portable and self-operated with which the smoker can smoke at home even during his/her usual activities. The data stored by this mobile assembly is then transferred to a treatment centre 2 (initiating laboratory) which conducts processing thereof and duplicates related smoking by means of a smoking machine 3 which mechanically reproduces the smoking of one or more cigarettes in accordance with a determined smoking profile based on the previously transferred data.

Figure 1:
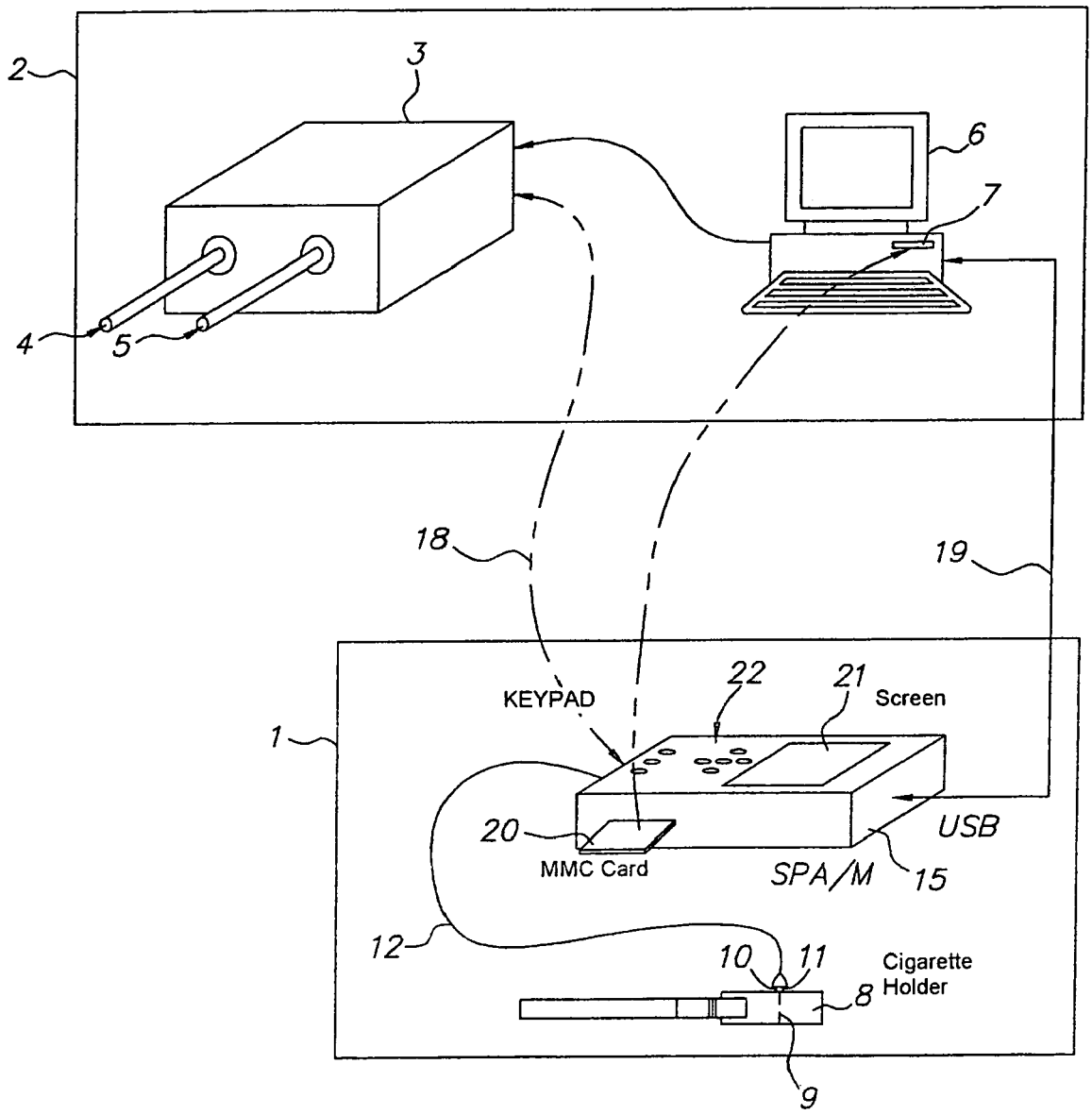
FIG. 1 is a schematic illustration of a device of the invention.
Figure 2:
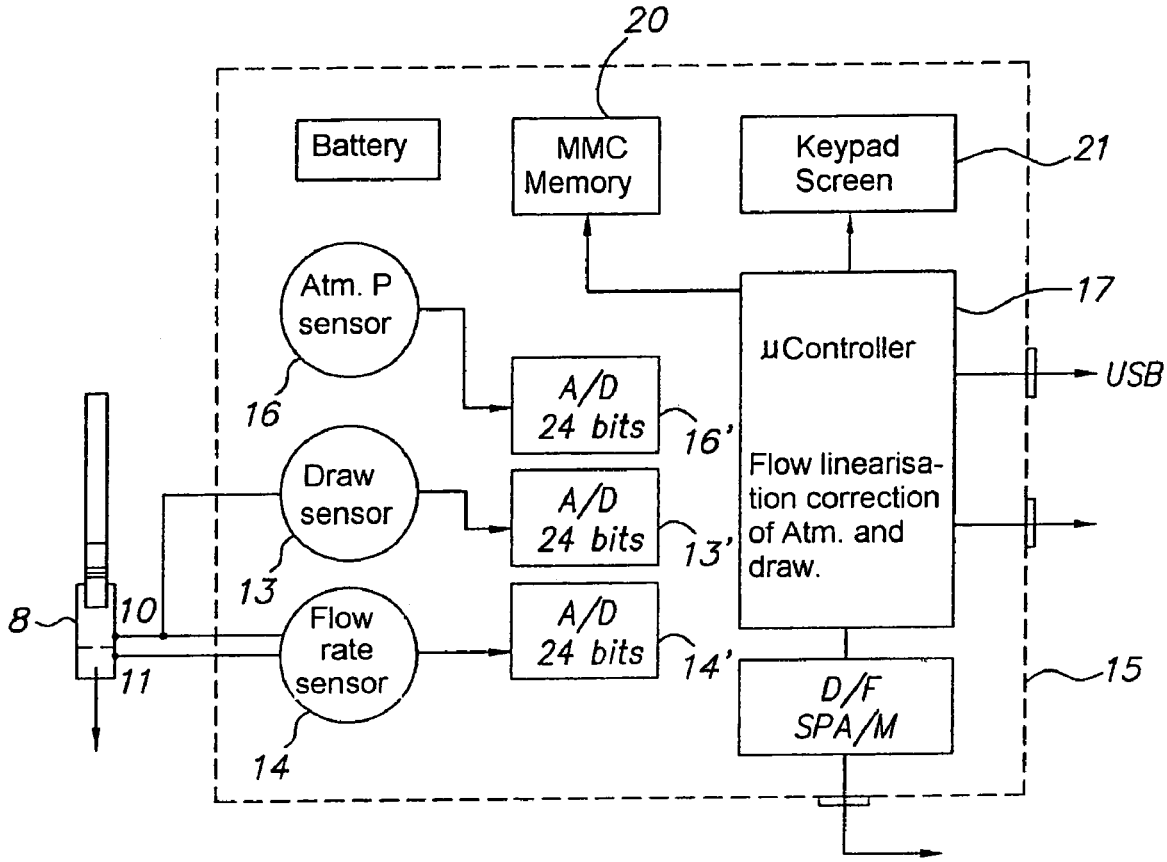
FIG. 2 is a schematic illustration of the principle of the electronic circuit of the mobile assembly of the device shown in FIG. 1.

In the example shown FIG. 1, this machine 3, which acts as cigarette smoking duplicator, comprises two ports 4, 5 each equipped with means for reproducing smoking based on a determined number of parameters such as:

Number of Puffs/Cigarette
Volume of each Puff

Total Cigarette Volume
Mean volume/Puff
Mean volume/Puff ($1^{st}$ and last puffs eliminated)
Mean volume/Puff ($1^{st}$ puff eliminated)
Duration of each Puff
Total duration of Puffs
Mean duration/Puff
Mean duration/Puff ($1^{st}$ and last puffs eliminated)
Mean duration/Puff ($1^{st}$ puff eliminated)
Mean flow rate of each puff
Mean flow rate/Puff
Mean flow rate/Puff ($1^{st}$ and last puffs eliminated)
Mean flow rate/Puff ($1^{st}$ puff eliminated)
Flow rate peak of each Puff
Mean flow rate peak/Puff
Mean flow rate peak/Puff ($1^{st}$ and last puffs eliminated)
Mean flow rate peak/Puff ($1^{st}$ puff eliminated)
Inter-puff interval
Total inter-puff interval
Mean inter-puff interval
Mean inter-puff interval ($1^{st}$ and last puffs eliminated)
Mean inter-puff interval ($1^{st}$ puff eliminated)
Total smoking time/cigarette
Effort per puff
Total effort
Mean effort per puff
Mean draw/puff
Mean total draw
Mean total draw/puff
Draw peak/puff
Mean draw peak
Mean resistance/puff
Mean total resistance/puff
Resistance peak/puff
Mean resistance peak
Date and time of start of smoking/cigarette
Atmospheric pressure This machine 3 is piloted by a processor, here of microcomputer type 6 equipped in particular with a USB port ("Universal Serial Bus") and with a memory card reader 7. This processor can be connected to a telecommunications network, such as the telephone network, GSM network, Internet network via a suitable MODEM (modulator/demodulator).

As mentioned above, the mobile assembly 1 used to conduct the test comprises a cigarette holder 8 fitted with a diaphragm 9 having two pressure test points 10, 11, arranged either side of the diaphragm so as to measure flow rate. The upstream test point 10 is also used to measure draw (with the use of pressure sensors having a very low dead volume it is possible to omit a third pressure test point reserved for draw, with no risk of mutual disturbance between flow rate and draw).

The pressure test points 10, 11 (and optionally the third pressure test point if such exists) are connected to sensors 13, 14 respectively provided in a processing module 15 associated with the cigarette holder via respective flexible tubes 12.

This processing module 15 also comprises an additional pressure sensor 16 intended to sense atmospheric pressure.

The information given by these sensors 13, 14, 16 is transmitted to respective analogue/digital converters 13', 14', 16', which deliver the digital data on detected pressure values to a central processing unit CPU 17 with a microprocessor which linearises pressure data, calculates flow rate and corrects flow rate data using atmospheric pressure and draw data.

Flow rate calculation is made using the differential pressure measured by sensor 14. This difference signal is quadratic. A root extractor linearises this value so that it can be recorded.

This central unit is also programmed to detect and validate puffs produced by the smoker compared with values for draw, flow rate, puff volume and puff duration and for inter-puff intervals of corresponding threshold values, using the following relationship for example:

A puff is detected and validated, if:
draw is above a threshold $S_1$
rate is above a threshold $S_2$
puff volume is above a threshold $S_3$
puff duration is above a threshold $S_4$
the inter-puff interval is above a threshold $S_5$ Identification of puffs can be made using a resistive contact incorporated in the cigarette holder, and associated with a flow rate threshold comparator. Puff volume can be determined by a counter associated with a threshold comparator and a voltage/frequency converter. Puff duration and the inter-puff interval can be obtained on a time basis.

Advantageously, the central unit 17 is programmed so as to determine and memorize the following parameters:

Number of puffs/cigarette
Volume of each puff
Total cigarette volume
Mean volume/puff
Mean volume/puff ($1^{st}$ and last puffs eliminated)
Mean volume/puff ($1^{st}$ puff eliminated)
Duration of each puff
Total duration of puffs
Mean duration/puff
Mean duration/puff ($1^{st}$ and last puffs eliminated)
Mean duration/puff ($1^{st}$ puff eliminated)
Mean flow rate of each puff
Mean flow rate/puff
Mean flow rate/puff ($1^{st}$ and last puffs eliminated)
Mean flow rate/puff ($1^{st}$ puff eliminated)
Flow rate peak of each puff
Mean flow rate peak/puff
Mean flow rate peak/puff ($1^{st}$ and last puffs eliminated)
Mean flow rate peak/puff ($1^{st}$ puff eliminated)
Inter-puff interval
Total inter-puff interval
Mean inter-puff interval
Mean inter-puff interval ($1^{st}$ and last puffs eliminated)
Mean inter-puff interval ($1^{st}$ puff eliminated)
Total duration of smoking time/cigarette
Effort per puff
Total effort
Mean effort per puff
Mean draw/puff
Mean total draw
Mean total draw/puff
Draw peak/puff
Mean draw peak
Mean resistance/puff
Mean total resistance/puff
Resistance peak/puff
Mean resistance peak
Date and time of start of smoking/cigarette
Atmospheric pressure The central unit 17 of the processing module 15 may be self-operated and comprise means enabling the piloting of the smoking machine 3. In this case, it is equipped with an input/output port enabling it to connect via a link 18 directly to a corresponding control port provided on the machine 3.

However, the invention is not limited to this solution. The smoking machine may be piloted by the micro-computer 6. In this case, the central unit 17 of the processing module 15 may be connected to the micro-computer 6 via a serial or parallel link, for example a USB link 19. This link enables the transfer in particular of data stored in the memory to the memories of the micro-computer 6.

The central unit 17 may also comprise, or in lieu or stead of said link 19, a removable memory 18 which can be removed from module 15 and inserted in a reader 7 equipping the micro-computer 6.

If the processing module 15 is self-operated, it may comprise a display member 21 enabling the display in particular of the parameters stored in memory and a graph showing the smoking profile, as well as menus corresponding to the different modes of operation of module 15. A keypad 22 may also be provided to ensure man/machine dialogue in association with the display member. The keypad 22 may be used in particular to enter a series of data enabling smoking identification in addition to date and time data.

Evidently, in the examples just described, the processing module 15 may be powered by a battery supplied by an internal charger or by the USB connector if such is used.

The invention claimed is:

1. Method for analysing cigarette smoking, which comprises the following steps:

equipping a smoker with a portable assembly comprising a cigarette holder comprising a diaphragm and two pressure sensors arranged on either side of said diaphragm and a processing module connected to said pressure sensors, said processing module comprising memorisation means with date/time recording data provided from said pressure sensors and transfer means for transferring said data, obtaining a smoking profile by collecting information from a smoking test during which said smoker smokes one or more cigarettes with said cigarette holder over a normal period of activity, in accordance with usual habits, said smoking test comprising a real-time detection by said pressure sensors and memorisation by said memorisation means, of said information comprising said data and corresponding date/time parameters, said smoking profile specific to the smoker being based on said data and corresponding date/time parameters once said smoking test is ended, transferring said information to a processor of a processing center which controls a smoking machine, controlling the smoking machine using the data transferred to said center so as to obtain the mechanical reproduction of smoking in accordance with said smoking profile.

2. Method as claimed in claim 1, wherein the piloting of the smoking machine is made directly from the processing module, data transfer being made by means of direct transfer means between said module and said smoking machine.

3. Method as claimed in claim 1, wherein the piloting of the smoking machine is made via a processor associated with the smoking machine, the data produced by the processing module being transferred from the processing module to the processor.

4. Method as claimed in claim 2, wherein data transfer is made by means of a removable memory or by a USB or RS232 link.

5. Method as claimed in claim 2, wherein data transfer is made via a telecommunications network, such as the telephone network, GSM network, Internet network.

6. Method as claimed in claim 1, wherein said above parameters are determined from pressure measurements made inside the cigarette holder and from atmospheric pressure.

7. Method as claimed in claim 6, wherein the data on pressure measurements is subjected to linearisation, flow rate calculation and correction of flow data using atmospheric pressure and draw data.

8. Method as claimed in claim 1, which comprises determination of parameters related to the measurement of pressure difference, either side of a diaphragm provided in the cigarette holder; this pressure difference being used to determine flow rate.

9. Method as claimed in claim 1, which comprises the detection and validation of puffs, a puff being detected and validated if:

draw is above a threshold,
flow rate is above a threshold,
puff volume is above a threshold,
puff duration is above a threshold,
the inter-puff interval is greater than a threshold.

10. Method as claimed in claim 1, which comprises memorisation, by a central unit of the processing module, of at least one of the following parameters:

Number of puffs/cigarette,
Volume of each puff,
Total cigarette volume,
Mean volume/puff,
Mean volume/puff ($1^{st}$ and last puffs eliminated),
Mean volume/puff ($1^{st}$ puff eliminated),
Duration of each puff;
Total duration of puffs,
Mean duration/puff,
Mean duration/puff ($1^{st}$ and last puffs eliminated),
Mean duration/puff ($1^{st}$ puff eliminated),
Mean flow rate of each puff,
Mean flow rate/puff,
Mean flow rate/puff ($1^{st}$ and last puffs eliminated),
Mean flow rate/puff ($1^{st}$ puff eliminated),
Flow rate peak of each puff,
Mean flow rate peak/puff,
Mean flow rate peak/puff ($1^{st}$ and last puffs eliminated),
Mean flow rate peak/puff ($1^{st}$ puff eliminated),
Inter-puff interval,
Total inter-puff interval,
Mean inter-puff interval,
Mean inter-puff interval ($1^{st}$ and last puffs eliminated),
Mean inter-puff interval ($1^{st}$ puff eliminated),
Total smoking time/Cigarette,
Effort per puff,
Total effort,
Mean effort per puff,
Mean draw/puff,
Mean total draw,
Mean total draw/puff,
Draw peak/puff,
Mean draw peak,
Mean resistance/puff,
Mean total resistance/puff,
Resistance peak/puff,
Mean resistance peak,
Date and time of start of smoking/cigarette, or
Atmospheric pressure.

* * * * *